US006821556B2

(12) United States Patent
Ishida et al.

(10) Patent No.: US 6,821,556 B2
(45) Date of Patent: Nov. 23, 2004

(54) PROCESS FOR PRODUCING HEAT SENSITIVE RECORDING MATERIAL

(75) Inventors: Koichi Ishida, Amagasaki (JP); Kazuo Watanabe, Amagasaki (JP); Hideki Tsuchida, Amagasaki (JP); Yutaka Isu, Amagasaki (JP)

(73) Assignee: OJI Paper Co., Ltd., Tokyo (JP)

( * ) Notice: Subject to any disclaimer, the term of this patent is extended or adjusted under 35 U.S.C. 154(b) by 243 days.

(21) Appl. No.: 10/111,852

(22) PCT Filed: Sep. 4, 2001

(86) PCT No.: PCT/JP01/07629

§ 371 (c)(1),
(2), (4) Date: Apr. 30, 2002

(87) PCT Pub. No.: WO02/20277

PCT Pub. Date: Mar. 14, 2002

(65) Prior Publication Data

US 2002/0187897 A1 Dec. 12, 2002

(30) Foreign Application Priority Data

Sep. 4, 2000 (JP) ..... 2000-266917

(51) Int. Cl.[7] ..... B41M 5/20; B41M 5/24; B41M 3/12; G03C 1/73; G03C 1/74

(52) U.S. Cl. ..... 427/152; 430/338; 430/961; 503/200; 503/207

(58) Field of Search ..... 503/200, 207; 430/338, 961; 427/152

(56) References Cited

U.S. PATENT DOCUMENTS

| | | | | | |
|---|---|---|---|---|---|
| 5,409,881 | A | * | 4/1995 | Mori et al. | 503/207 |
| 5,427,996 | A | * | 6/1995 | Motoda et al. | 503/200 |
| 5,919,729 | A | | 7/1999 | Mori et al. | 503/200 |
| 6,060,427 | A | * | 5/2000 | Mori et al. | 503/200 |
| 6,410,479 | B1 | * | 6/2002 | Fukuchi et al. | 503/200 |
| 2003/0045427 | A1 | * | 3/2003 | Sakutai et al. | 503/200 |

FOREIGN PATENT DOCUMENTS

| | | | |
|---|---|---|---|
| EP | 0 431 594 | A1 | 6/1991 |
| EP | 0 436 390 | A2 | 7/1991 |
| EP | 0 587 139 | A2 | 3/1994 |
| EP | 0 614 767 | A1 | 9/1994 |
| EP | 0 997 316 | A1 | 5/2000 |
| JP | 6-32056 | A | 2/1994 |
| JP | 8-90909 | A | 4/1996 |
| JP | 8-244348 | A | 9/1996 |
| JP | 10-287045 | A | 10/1998 |
| JP | 11-58974 | A | 3/1999 |
| JP | 2000-71617 | A | 3/2000 |
| JP | 2001-270251 | A | 10/2001 |
| JP | 2001-310559 | A | 11/2001 |

* cited by examiner

*Primary Examiner*—Richard L. Schilling
(74) *Attorney, Agent, or Firm*—Kubovcik & Kubovcik

(57) ABSTRACT

Disclosed are a heat-sensitive recording material comprising a support, a heat-sensitive recording layer comprising a leuco dye and a developer, and a protective layer comprising a resin in the form of a film, the protective layer being obtained by coating the heat-sensitive recording layer with a protective layer aqueous coating composition comprising at least resin particles having a core/shell structure and then drying the coating, wherein the resin in the form of a film formed of said resin particles having a core/shell structure is present in an amount of not less than 80 mass % of the total solids of the protective layer, and the protective layer having a gloss (based on JIS P 8142) of not less than 80%, a heat-sensitive recording material comprising an interlayer between the heat-sensitive recording layer and the support of the heat-sensitive recording material, as well as processes for preparing these heat-sensitive recording materials.

18 Claims, No Drawings

PROCESS FOR PRODUCING HEAT SENSITIVE RECORDING MATERIAL

TECHNICAL FIELD

The present invention relates to a heat-sensitive recording material utilizing the color-forming reaction between a leuco dye and a developer, and in particular relates to such a heat-sensitive recording material with a protective layer having better gloss, as well as a method for its production.

BACKGROUND ART

Heat-sensitive recording materials which make use of the color forming reaction of a leuco dye with a developer induced by heat are relatively inexpensive, and recording devices for these materials are compact and easy to maintain. Consequently such recording materials are widely used as recording media for facsimile systems, various computers and other application.

With the expansion of the scope of application of such heat-sensitive recording materials, there is a demand for a heat-sensitive recording material which has higher grade gloss. However, attempts to increase the gloss of the protective layer of heat-sensitive recording materials often cause sticking of the protective layer to the thermal heads of printers during recording, failing to obtain uniform record images, or result in inadequate runnability during recording.

In order to improve water resistance, runnability during recording and chemical resistance of the heat-sensitive recording material, Japanese Unexamined Patent Applications (Kokai) H5-69665, H5-318926, and H6-171237 disclose heat-sensitive recording materials comprising a resin-based protective layer which is obtained by applying to the heat-sensitive recording layer a protective layer aqueous coating composition containing a latex with a core/shell structure, and then drying the coating. However, the gloss of the protective layers of these heat-sensitive recording materials needs to be improved.

In order to improve the gloss of the protective layer, Japanese Unexamined Patent Publication (Kokai) 2000-71617 discloses a heat-sensitive recording material in which a protective layer is formed by applying a protective layer aqueous coating composition containing a latex with a core/shell structure to a high-smoothness film or a metal surface having a chromium-plated mirror finish, which is separate from the support, drying the coating to form a protective layer, and then laminating the protective layer onto the heat-sensitive recording layer. However, the productivity and manufacturing costs are problematic.

An object of the present invention is to provide a heat-sensitive recording material having excellent gloss and excellent sticking resistance and water resistance.

DISCLOSURE OF THE INVENTION

In heat-sensitive recording materials which comprise a heat-sensitive recording layer containing a leuco dye and a developer on a support and a protective layer comprising a resin in the form of a film, the present invention uses, as a means for achieving the aforementioned object, a protective layer which is obtained by applying a protective layer aqueous coating composition comprising at least resin particles having a core/shell structure to the heat-sensitive recording layer and drying the coating, the resin in the form of a film formed from the resin particles with the core/shell structure in the resulting protective layer being present in an amount of not less than 80 mass % relative to the total amount of solids of the protective layer, and the protective layer having a gloss (based on JIS P 8142) of not less than 80%.

Specifically, the present invention provides a heat-sensitive recording material characterized in that it comprises (a) a support, (b) a heat-sensitive recording layer comprising a leuco dye and a developer, and (c) a protective layer comprising a resin in the form of a film and formed on the heat-sensitive recording layer, the protective layer being obtained by coating the heat-sensitive recording layer with a protective layer aqueous coating composition comprising at least resin particles having a core/shell structure, and then drying the coating, wherein the resin in the form of a film formed of the resin particles having a core/shell structure is present in an amount of not less than 80 mass % of the total solids of the protective layer, and the protective layer having a gloss (based on JIS P 8142) of not less than 80%.

The present invention also provides a heat-sensitive recording material characterized in that it comprises (i) a support, (ii) a heat-sensitive recording layer comprising a leuco dye and a developer, (iii) an interlayer comprising a film-forming resin and formed on the heat-sensitive recording layer, and (iv) a protective layer comprising a resin in the form of a film, the protective layer being obtained by coating the interlayer with a protective layer aqueous coating composition comprising at least resin particles having a core/shell structure, and then drying the coating, wherein the resin in the form of a film formed of the resin particles having a core/shell structure is present in an amount of not less than 80 mass % of the total solids of the protective layer, and the protective layer having a gloss (based on JIS P 8142) of not less than 80%.

The present invention also provides a process for producing a heat-sensitive recording material comprising (a) a support, (b) a heat-sensitive recording layer comprising a leuco dye and a developer, and (c) a protective layer comprising a resin in the form of a film and formed on the heat-sensitive recording layer, wherein the protective layer having a gloss (based on JIS P 8142) of not less than 80%, the process being characterized in that it comprises coating the heat-sensitive recording layer with a protective layer aqueous coating composition comprising resin particles having a core/shell structure in an amount of not less than 80 mass % of the total solids of the protective layer aqueous coating composition, and then drying the coating.

Furthermore, the present invention provides a process for producing a heat-sensitive recording material comprising (i) a support, (ii) a heat-sensitive recording layer comprising a leuco dye and a developer, (iii) an interlayer comprising a film-forming resin and formed on the heat-sensitive recording layer, and (iv) a protective layer comprising a resin in the form of a film and formed on the interlayer, wherein the protective layer has a gloss (based on JIS P 8142) of not less than 80%, the process being characterized in that it comprises the steps of:

- forming a recording material comprising the support and the heat-sensitive recording layer,
- coating the heat-sensitive recording layer with an interlayer coating composition comprising a film-forming resin and then drying the coating composition to form the interlayer, and
- coating the interlayer with a protective layer aqueous coating composition comprising at least resin particles having a core/shell structure, the protective layer aqueous coating composition comprising the resin particles with a core/shell structure in an amount of not less than 80 mass % of the total solids of the protective layer aqueous coating composition, and then drying the coating.

The present invention will be described below in detail.

Protective Layer

<Protective Layer Gloss>

As described above, the heat-sensitive recording material of the present invention is characterized in that the protective layer is obtained by coating the heat-sensitive recording layer with a protective layer aqueous coating composition comprising resin particles with a core/shell structure, and then drying the coating, wherein the resin in the form of a film formed of the resin particles having a core/shell structure (specific resin) is present in an amount of not less than 80 mass % relative to the total solids of the protective layer, and wherein the protective layer has a gloss (based on JIS P 8142) of not less than 80%.

A means for ensuring that the protective film of the present invention has a gloss of not less than 80% is, for example, to form a protective layer by coating the heat-sensitive recording layer with a protective layer aqueous coating composition containing resin particles with a core/shell structure which have a mean particle diameter of between about 0.05 and 0.5 $\mu$m, and to then dry the coating. In the protective layer thus formed, the resin in the form of a film formed from the aforementioned resin particles is present in an amount of not less than 80 mass % relative to the total solids of the protective layer. The protective layer aqueous coating composition is applied such that the coating amount after drying is about 0.5 to 5.0 g/m$^2$.

Resin particles with a core/shell structure that have a mean particle diameter greater than 0.5 $\mu$m tend to result in a protective layer with less than 80% gloss, whereas resin particles having a mean particle diameter less than 0.05 $\mu$m are likely to aggregate with the result that the gloss is less than 80%. A range of about 0.1to 0.4 $\mu$m is preferred. As used in the Specification and Claims, the mean particle diameter of the resin particles with the core/shell structure is the value determined using a laser diffraction particle size distribution analyzer (product name "SALD2000", product of Shimadzu Seisakusho).

The protective layer gloss is the value obtained immediately after the heat-sensitive recording layer is coated with the protective layer aqueous coating composition and the coating is dried to form a protective layer, or after the protective layer formed has been subjected to a smoothing treatment by supercalendering or the like. It is preferable that the protective layer gloss is not less than 80% even immediately after the protective layer is formed by coating the heat-sensitive recording layer with the protective layer aqueous coating composition and then drying the coating (before being subjected to a smoothing treatment by supercalendering or the like).

Another means for obtaining a heat-sensitive recording material with a protective layer gloss of not less than 80% is to increase the transparency of the protective layer (low haze value, based on JIS K 7105). For example, it is preferable that when the protective layer aqueous coating composition is applied to a transparent polyethylene terephthalate (PET) film with a haze value of not more than 1 (such as one available under a tradename "HMW100", from Teijin) in an amount of 3 g/m$^2$ on dry basis and the coating is dried, the haze value, as determined using a haze meter (tradename: TC-H1V, by Tokyo Denshoku) be not more than about 10%, particularly not more than 5%.

<Resin Particles With Core/Shell Structure>

In the resin particles with a core/shell structure, the resin of the shell preferably has a glass transition temperature (Tg) of not less than 200° C. The use of a shell resin having a Tg of lower than 200° C. tends to impart lower sticking resistance during recording by a thermal head and may fail to give uniform record images.

The resin of the shell component of the resin particles with the core/shell structure is obtained by the seed polymerization of one or more monomers in the presence of a seed particle aqueous dispersion. Particularly preferable examples of such composite particles wherein the shell thereof has a Tg of at least 200° C. are those prepared by the seed polymerization of at least one member selected from the group consisting of methacrylamide and acrylamide.

Such resins can be obtained by emulsion polymerization using at least one member selected from the group consisting of methacrylamide and acrylamide, and hydrophobic polymer particles (seed particles) of an unsaturated monomer as the core according to a known method, such as the method described in Japanese Unexamined Patent Publication (Kokai) H5-69665.

Said at least one material selected from the group consisting of methacrylamide and acrylamide will hereinafter be referred to as "(meth)acrylamide." Similarly, as used in the specification, the term "(meth)acrylic acid" means at least one member selected from the group consisting of methacrylic acid and acrylic acid, and the term "(meth) acrylonitrile" means at least one member selected from the group consisting of methacrylonitrile and acrylonitrile.

The content of (meth)acrylamide in the seed polymerized shell resin is 50 to 100 mass parts, and preferably 70 to 100 mass parts, per 100 mass parts of the seed polymerized shell resin.

If desired, other unsaturated monomers which are copolymerizable with (meth)acrylamide can be used during the seed polymerization of (meth)acrylamide. Examples of such other unsaturated monomers include methyl (meth)acrylate, ethyl (meth)acrylate, butyl (meth)acrylate, 2-ethylhexyl (meth)acrylate, 2-hydroxyethyl (meth)acrylate, 2-hydroxypropyl (meth)acrylate, 2-aminoethyl (meth) acrylate, glycidyl (meth)acrylate, (meth)acrylic acid, maleic anhydride, itaconic acid, fumaric acid, crotonic acid, (meth) acrylonitrile, styrene, $\alpha$-methylstyrene, divinyl benzene and the like.

Examples of seed particles include latex based on acrylic acid ester such as methyl (meth)acrylate, ethyl (meth) acrylate, butyl (meth)acrylate and the like, styrene-butadiene latex, styrene-acrylic acid ester latex, and various other known latex particles. (Meth)acrylamide may also be present as copolymerized in the seed particles.

Seed particles, of course, are not limited to these, and two or more kinds of them may be used in admixture. Seed particles with a Tg higher than 150° C. are likely to have a higher film-forming temperature, resulting in lower transparency of the protective layer and failing to form a protective layer with a gloss of not less than 80%. Therefore, it is preferable that the seed particles have a Tg of about −10 to +50° C. In order to lower the film-forming temperature, film-forming aids may be used.

The resin particles with a core/shell structure having a mean particle diameter of between about 0.05 and 0.5 $\mu$m are prepared by the process mentioned above by suitably selecting the conditions, such as adjusting the mean particle diameter of the starting seed particles, or adjusting the amount of the monomer(s) used for the seed polymerization so as to adjust the thickness of the shell.

The protective layer aqueous coating composition containing the aforementioned resin particles having a core/shell structure, when applied to the heat-sensitive recording layer and dried, forms a film, giving a protective layer with high gloss.

<Lubricant>

The protective layer can include a lubricant if so desired. This is preferred in order to ensure virtually no loss of gloss over time and to ensure better effects due to better sticking resistance. A lubricant is preferably used in an amount of about 1 to 10 mass % relative to the total solids of the protective layer. Less than 1 mass % will result in less improvement in the sticking resistance, while more than 10 mass % is likely to give a protective layer with less than 80% gloss. An amount between 2 and 8 mass % is more desirable. The lubricant may have a mean particle diameter of between 0.1 and 3.0 $\mu$m, preferably between about 0.1 and 1.0 $\mu$m.

Specific examples of lubricants include zinc stearate, calcium stearate, polyethylene wax, carnauba wax, paraffin wax, ester wax and like waxes, mono- or di-lauryl phosphate, mono- or di-oleyl phosphate, mono- or di-stearyl phosphate and other mono- or di-alkyl phosphates and their alkali metal salts, glyceryl monomyristate, glyceryl monostearate, glyceryl monooleate, glyceryl distearate, glyceryl dioleate and like glycerin fatty acid esters, diglyceryl monolaurate, diglyceryl dilaurate, tetraglyceryl monolaurate, hexaglyceryl monolaurate, decaglyceryl monolaurate and like polyglycerin fatty acid esters, and silicone oil.

Of these, at least one member selected from the group consisting of polyethylene wax, zinc stearate and zinc stearyl phosphate is preferred. The combined use of polyethylene wax and zinc stearate or the combined use of zinc stearate and zinc stearyl phosphate are especially preferred because of the extremely low loss of gloss and the better sticking resistance.

<Crosslinking Agent>

The protective layer can contain a crosslinking agent if so desired. The use thereof produces the effects of improving the water resistance of the protective layer, of entailing less loss of the protective layer gloss over time and of imparting better sticking resistance.

Specific examples of crosslinking agents include polyamideamine-epichlorohydrin resins, glyoxal, dialdehyde starch and like dialdehyde compounds, polyethyleneimine and like polyamine compounds, melamine resins, glycerin diglycidyl ethers and like diglycidyl compounds, dimethylurea compounds, aziridine compounds, adipic dihydrazide and like polycarboxylic acid hydrazide compounds, oxazoline, as well as ammonium persulfate, borax, boric acid, and ammonium zirconium carbonate. Of these, polyamideamine-epichlorohydrin resins are preferred.

The invention is not limited to these, of course, and two or more of them can be used in combination. The use of too much crosslinking agent tends to result in a loss of gloss, and therefore the crosslinking agent is preferably used in an amount of between about 1 and 20 mass %, particularly between about 2 and 10 mass %, relative to the specific resin in the protective layer (when the other resins to be described below are additionally used, the above amount is relative to the total amount of the specific resin and said other resins).

<Other Resins>

The protective layer can include water-soluble or water-dispersible resins other than the resin particles with a core/shell structure, provided that the desired effects of the present invention are not thereby impaired. Examples of such water-soluble or water-dispersible resins include partially or fully saponified polyvinyl alcohols, acetoacetyl-modified polyvinyl alcohols, diacetone-modified polyvinyl alcohols, silicon-modified polyvinyl alcohols and carboxy-modified polyvinyl alcohols. Their polymerization degree is preferably between about 300 and 3000. The saponified polyvinyl alcohols preferably have a degree of saponification of not less than 80 mol %. The aforementioned modified polyvinyl alcohols preferably have a modification degree of about 1 to 10 mol %.

Examples of other resins also include oxidized starches, hydroxyethyl cellulose, methyl cellulose, carboxymethyl cellulose, gelatin, casein, gum arabic, diisobutylene-maleic anhydride copolymer salts, styrene-maleic anhydride copolymer salts, ethylene-acrylic acid copolymer salts, styrene-acrylic acid copolymer salts, polyurethane latex, styrene-butadiene latex, etc. The present invention is not limited to these, of course, and two or more of them can be used in combination.

Of these, at least one member selected from the group consisting of partially or fully saponified polyvinyl alcohols and modified polyvinyl alcohols is preferred. At least one member selected from the group consisting of acetoacetyl-modified polyvinyl alcohols and diacetone-modified polyvinyl alcohols is especially preferred.

When said other resins are used, the amount thereof is about 0.5 to 10 mass parts, preferably about 0.5 to 5 mass parts, per 100 mass parts of the resin in the form of a film formed from the resin particles having a core/shell structure.

<Protective Layer Aqueous Coating Composition>

The protective layer is formed, for example, by stirring and mixing the resin particles with a core/shell structure, particularly resin particles with a core/shell structure which have a mean particle diameter of between about 0.05 and 0.5 $\mu$m, and if desired a wax and a crosslinking agent and optionally the following additives in water serving as a dispersion medium to thereby prepare a protective layer aqueous coating composition, applying the protective layer aqueous coating composition to the heat-sensitive recording layer, and drying the resulting coating. In preparing the protective layer aqueous coating composition, the emulsion obtained during the preparation of the resin particles with the core/shell structure by seed polymerization can be used as such.

Examples of additives that can be contained in the protective layer aqueous coating composition include pigments such as amorphous silica, calcium carbonate, zinc oxide, aluminum oxide, titanium dioxide, aluminum hydroxide, barium sulfate, talc, kaolin, clay, calcined kaolin, urea-formalin resin fillers, each having a mean primary particle diameter of approximately 0.01 to 2.0 $\mu$m, sodium dioctylsulfosuccinate, sodium dodecylbenzenesulfonate, sodium lauryl sulfate, fatty acid metal salts and like surfactants, defoaming agents, thickeners, pH adjusting agents, UV absorbers, photostabilizers, fluorescent dyes, and coloring dyes. The present invention is not limited to these, of course, and they can be used in combinations of two or more. However, the use of pigments and poorly miscible substances or the like in particular tend to reduce gloss, and therefore should be used with caution.

Heat-sensitive Recording Layer

The heat-sensitive recording layer can contain various known leuco dyes and developers. Specific examples of leuco dyes include dyes capable of forming blue color, such as 3,3-bis(p-dimethylaminophenyl)-6-dimethylaminophthalide, 3-(4-diethylamino-2-methylphenyl)-3-(4-dimethylaminophenyl)-6-dimethylaminophthalide and 3-diethylamino-7-dibenzylamino-benzo[a]fluoran; dyes capable of forming green color, such as 3-(N-ethyl-N-p-tolyl)amino-7-N-methylanilinofluoran, 3-diethylamino-7-anilinofluoran, and 3-diethylamino-7-dibenzylaminofluoran; dyes capable of forming red color, such as 3-cyclohexylamino-6-chlorofluoran, 3-diethylamino-6-methyl-7-chlorofluoran, and 3-diethylamino-6,8-dimethylfluoran; dyes capable of forming black color, such as 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-di(n-butyl)amino-7-(o-fluorophenylamino)fluoran, 3-(N-ethyl-p-toluidino)-6-methyl-7-anilinofluoran, 3-(N-ethyl-N-tetrahydrofurfurylamino)-6-methyl-7-anilinofluoran and 3-diethylamino-6-chloro-7-anilinofluoran; and dyes having absorption wavelengths in the near infrared region, such as 3,3-bis[1-(4-methoxyphenyl)-1-(4-dimethylamino-phenyl)ethylen-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran and 3,6-bis(dimethylamino)fluoren-9-spiro-3'-(6'-dimethylamino)phthalide. Such leuco dyes are used in an amount of about 5 to 35 mass % based on the heat-sensitive recording layer.

Specific examples of developers include 4,4'-isopropylidenediphenol, 4,4'-cyclohexylidenediphenol, 2,2-bis(4-hydroxyphenyl)-4-methylpentane, benzyl 4-hydroxybenzoate, 2,4'-dihydroxydiphenylsulfone, 4,4'-dihydroxydiphenylsulfone, 4-hydroxy-4'-isopropoxydiphenylsulfone, bis(3-allyl-4-hydroxyphenyl)sulfone, butyl bis(p-hydroxyphenyl)acetate, 1,1-bis(4-hydroxyphenyl)-1-phenylethane, 1,4-bis[α-methyl-α-(4'-hydroxyphenyl)ethyl]benzene, 1,3-bis{α-methyl-α-(4'-hydroxyphenyl)ethyl}benzene and like phenolic compounds, p-cumylphenyl N-(p-toluenesulfonyl)carbamate, N-(o-tolyl)-p-toluenesulfonamide, 4,4'-bis(N-p-toluenesulfonylaminocarbonylamino)diphenylmethane and like compounds containing —$SO_2NH$— bond(s) within the molecule, and zinc p-chlorobenzoate, zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate and like zinc salts of aromatic carboxylic acids.

The ratio of the leuco dye to the developer is not particularly limited and may be suitably selected according to the type of leuco dye and developer used, but the developer is generally used in an amount of 1 to 10 mass parts, preferably 1 to 5 mass parts, per mass part of the leuco dye.

The heat-sensitive recording layer may also contain a print-stability improving agent to enhance the stability of record images, as well as a sensitizer to enhance recording sensitivity. Examples of such print-stability improving agent include 2,2'-methylenebis(4-methyl-6-tert-butylphenol), 4,4'-thiobis(2-methyl-6-tert-butylphenol), 4-4'-butylidenebis(6-tert-butyl-m-cresol), 1,1,3-tris(2-methyl-4-hydroxy-5-tert-butylphenyl)butane, 1,1,3-tris(2-methyl-4-hydroxy-5-cyclohexylphenyl)butane, 2,2-bis(4-hydroxy-3,5-dibromophenyl)propane, 2,2-bis(4-hydroxy-3,5-dimethylphenyl)propane and like hindered phenol compounds, and 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol Novolak type epoxy resins, phenol Novolak type epoxy resins, bisphenol A type epoxy resins and like epoxy compounds.

Specific examples of sensitizers include stearic acid amides, methylene bistearamide, dibenzyl terephthalate, benzyl p-benzyloxybenzoate, 2-naphthylbenzyl ether, m-terphenyl, p-benzylbiphenyl, p-tolylbiphenyl ether, di(p-methoxyphenoxyethyl) ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, p-methylthiophenyl benzyl ether, 1,4-di(phenylthio)butane, p-acetotoluidide, p-acetophenetidide, N-acetoacetyl-p-toluidine, di(β-biphenylethoxy)benzene, p-di(vinyloxyethoxy)benzene, 1-isopropylphenyl-2-phenylethane, di-p-chlorobenzyl oxalate, di-p-methylbenzyl oxalate and dibenzyl oxalate.

Although the amounts of such print-stability improving agents and sensitizers are not particularly limited, it is generally preferable that per mass part of the developer, the print-stability improving agent is used in an amount of between 0.5 and 4 mass parts, and the sensitizer is used in an amount of between 0.5 and 4 mass parts.

Of course, the invention is not limited to the above leuco dyes, developers, print-stability improving agents, and sensitizers, and they can be used in combinations of two or more.

The heat-sensitive recording layer is generally formed by microdispersing a leuco dye, a developer and if desired a sensitizer or print-stability improving agent, etc. in water serving as a dispersion medium, either jointly or separately, to a mean particle diameter of not more than 2 μm by means of a stirring and pulverizing apparatus such as a ball mill, an attritor or a sand mill, then adding a binder to the dispersion, applying the resulting heat-sensitive recording layer coating composition to a support in such a manner that the coating amount of the coating composition after drying it is about 2 to 20 g/$m^2$, preferably about 3 to 10 g/$m^2$, and drying the coating.

Specific examples of binders which may be used in the heat-sensitive recording layer include starches, hydroxyethyl cellulose, methyl cellulose, carboxymethyl cellulose, gelatin, casein, gum arabic, polyvinyl alcohol, carboxy-modified polyvinyl alcohol, acetoacetyl group-modified polyvinyl alcohol, silicon-modified polyvinyl alcohol, diisobutylene-maleic anhydride copolymer salts, styrene-maleic anhydride copolymer salts, ethylene-acrylic acid copolymer salts, styrene-acrylic acid copolymer salts, urea resins, melamine resins, amide resins, polyurethane latex and styrene-butadiene latex. The binder is used in an amount of about 5 to 30 mass % relative to the total solids of the heat-sensitive recording layer.

The heat-sensitive recording layer coating composition can also contain the crosslinking agents, waxes and auxiliaries which may be contained in the aforementioned protective layer aqueous coating composition.

Interlayer

In order to enhance the chemical resistance of the recorded portion, an interlayer comprising, for example, a film-forming aqueous resin and if desired a pigment is formed between the heat-sensitive recording layer and the protective layer, and this improves gloss after the formation of the protective layer.

The interlayer is formed by coating the heat-sensitive recording layer with an interlayer coating composition comprising, for example, a film-forming resin and if desired a pigment in water serving as the medium in such a manner that the coating amount of the coating composition after drying is about 0.2 to 5.0 g/m$^2$, preferably about 0.5 to 3.0 g/m$^2$, and then drying the coating. The content of the film-forming resin in the interlayer is preferably not less than 70 mass % relative to the total solids of the interlayer.

Examples of film-forming resins which may be contained in the interlayer include at least one member selected from the group consisting of water-soluble resins and water-dispersible resins, such as fully saponified polyvinyl alcohol, partially saponified polyvinyl alcohol, carboxy-modified polyvinyl alcohols, acetoacetyl-modified polyvinyl alcohols, silicon-modified polyvinyl alcohols, diacetone-modified polyvinyl alcohols and like polyvinyl alcohols, as well as starches, hydroxyethyl cellulose, methyl cellulose, carboxymethyl cellulose, gelatin, casein, gum arabic, diisobutylene-maleic anhydride copolymer salts, styrene-maleic anhydride copolymer salts, ethylene-acrylic acid copolymer salts, styrene-acrylic acid copolymer salts, acrylic latex, and urethane latex. Of course, the invention is not limited to these, and they can be used in combinations of two or more.

Of these, modified polyvinyl alcohols are preferred. At least one member selected from the group consisting of carboxy-modified polyvinyl alcohols, acetoacetyl-modified polyvinyl alcohols, silicon-modified polyvinyl alcohols, and diacetone-modified polyvinyl alcohols are especially preferred for their excellent reactivity with crosslinking agents.

Examples of pigments include those mentioned with respect to the protective layer above. The invention is not limited to those pigments, of course, and they can be used in combinations of two or more. While the amount of the pigment to be used can be selected from a wide range, the amount is generally about 5 to 30 mass %, preferably between about 10 and 25 mass %, relative to the total solids of the interlayer.

If desired, the interlay coating composition can also contain the crosslinking agents, waxes, and auxiliaries which may be contained in the protective layer aqueous coating composition described above.

Undercoat Layer

If needed, an undercoat layer can also be provided between the support and heat-sensitive recording layer in the present invention to further improve recording sensitivity and runnability during recording. The undercoat layer is formed by coating the support with an undercoat layer coating composition comprising a binder as well as an oil-absorbing pigment having an oil absorption of not less than 70 ml/100 g, preferably about 80 to 150 ml/100 g and/or organic hollow particles. As used herein, the oil absorption is determined in accordance with JIS K 5101.

Although various types of oil-absorbing pigments can be used, typical examples include inorganic pigments such as calcined kaolin, amorphous silica, precipitated calcium carbonate and talc. Such oil-absorbing pigments preferably have a mean primary particle diameter of between about 0.01 and 5 $\mu$m, preferably between about 0.02 and 3 $\mu$m. The amount of the oil-absorbing pigment to be used can be selected from a wide range, but the amount is generally between about 50 and 95 wt %, preferably between about 70 and 90 wt %, relative to the undercoat layer.

Examples of organic hollow particles are those heretofore known, and include particles in which the shell is made of an acrylic resin, styrene resin, vinylidene chloride resin or the like and which has a void ratio of about 50 to 99%. As used herein, the void ratio is the value determined by $(d/D)\times 100$, wherein d is the inside diameter of the organic hollow particle, and D is the outside diameter of the organic hollow particle. The organic hollow particles preferably have a mean particle diameter of between about 0.5 and 10 $\mu$m, preferably between about 1 and 3 $\mu$m. Although the amount of the aforementioned organic hollow particles can be selected from a wide range, the amount is generally 20 to 90 wt %, preferably about 30 to 70 wt %, relative to the undercoat layer.

When the aforementioned oil-absorbing inorganic pigments are used in combination with the organic hollow particles, the oil-absorbing inorganic pigment and organic hollow particles are used in an amount within the aforementioned range, and the total amount of the oil-absorbing inorganic pigment and the organic hollow particles is preferably about 40 to 90 wt %, preferably abut 50 to 80 wt %, relative to the undercoat layer.

Examples of the above binder include the binders which are used in the aforementioned heat-sensitive recording layer, especially starch-vinyl acetate graft copolymers, polyvinyl alcohols, styrene-butadiene latex and the like.

The amount of the aforementioned binder can be selected from a wide range, but it is generally preferable that the amount is about 5 to 30 wt %, particularly 10 to 20 wt %, relative to the undercoat layer.

The undercoat layer is preferably applied in an amount of about 3 to 20 g/m$^2$, preferably about 5 to 12 g/m$^2$, on a dry weight basis. Any heretofore known method can be used as a method for applying the undercoat layer coating composition.

Heat-sensitive Recording Material

The method for forming the heat-sensitive recording layer, interlayer and protective layer is not particularly limited. For example, one or both sides of a support can be coated with the heat-sensitive recording layer coating composition by a suitable method such as air knife coating, Vari-Bar blade coating, pure blade coating, gravure coating, rod/blade coating, short dwell coating, curtain coating, and die coating, and the protective layer aqueous coating composition is then applied to the heat-sensitive recording layer. The support can be suitably selected from paper (acid-free paper or acidic paper), plastic films, synthetic paper, non-woven fabrics, metal vapor-deposited materials, and the like.

When producing a heat-sensitive recording material comprising an interlayer, the heat-sensitive recording layer is formed on the support to obtain a recording material, and the interlayer coating composition is applied to and dried on the heat-sensitive recording layer to form the interlayer, and the protective layer aqueous coating composition is applied to and dried on the interlayer to form the protective layer.

When producing a heat-sensitive recording material with an undercoat layer, the undercoat layer coating composition is applied to and dried on the support to form the undercoat layer, and the heat-sensitive recording layer is formed on the resulting undercoat layer, and a protective layer is provided on the heat-sensitive recording layer or alternatively an interlayer and a protective layer are provided on the heat-sensitive recording layer.

A variety of common techniques in the filed of heat-sensitive recording material manufacturing can be added as needed, such as smoothing treatment by supercalendering or the like after the layers have been formed, providing an adhesive layer or a barrier layer on the other side of the support, or perforating the heat-sensitive recording material. The heat-sensitive recording material of the present invention is particularly suitable for adhesive label applications when an adhesive layer is provided on the other side of the support.

EXAMPLES

The present invention will be described below in detail with reference to examples, but is not limited to these examples. Parts and percentages in the examples are mass parts and mass %, unless otherwise specified.

Example 1

Preparation of Undercoat Layer Coating Composition

An undercoat coating composition was obtained by mixing and stirring a composition composed of 100 parts of calcined kaolin (tradename: Ansilex, manufactured by EC; oil absorption: 110 ml/100 g), 1 part of 40% aqueous solution of sodium polyacrylate, 14 parts of styrene-butadiene latex with a solids concentration of 48%, 50 parts of a 10% aqueous solution of polyvinyl alcohol (degree of saponification: 98 mol %; degree of polymerization: 500), and 200 parts of water.

Preparation of Heat-sensitive Recording Layer Coating Composition

Preparation of Dispersion A

A composition composed of 20 parts of 3-di(n-butyl) amino-6-methyl-7-anilinofluoran, 5 parts of 5% aqueous solution of methyl cellulose, and 25 parts of water was pulverized to a mean particle size of 1.0 μm in a sand mill.

Preparation of Dispersion B

A composition composed of 20 parts of 4-hydroxyphenyl-4'-isopropoxyphenylsulfone, 5 parts of a 5% aqueous solution of methyl cellulose and 25 parts of water was pulverized to a mean particle size of 1.0 μm in a sand mill.

Preparation of Dispersion C

A composition composed of 20 parts of di-p-methylbenzyl oxalate, 5 parts of a 5% aqueous solution of methyl cellulose and 25 parts of water was pulverized to a mean particle size of 1.0 μm in a sand mill.

Heat-sensitive Recording Layer Coating Composition 25 parts of Dispersion A, 50 parts of Dispersion B, 50 parts of Dispersion C, 100 parts of 10% aqueous solution of polyvinyl alcohol, 20 parts of styrene-butadiene latex with a solids concentration of 50%, 50 parts of precipitated calcium carbonate and 5 parts of adipic dihydrazide were mixed and stirred, giving a heat-sensitive recording layer coating composition.

Preparation of Interlayer Coating Composition

A composition composed of 800 parts of a 10% aqueous solution of diacetone-modified polyvinyl alcohol (tradename: D-500, manufactured by Unitika Chemical) and 50 parts of a 40% aqueous dispersion of kaolin (tradename: UW-90; mean particle diameter: 0.8 μm; manufactured by Engelhard) was mixed and stirred, giving an interlayer coating composition.

Preparation of Protective Layer Aqueous Coating Composition 250 parts of latex of resin particles with a core/shell structure having a solids concentration of 37% (tradename: XFE3571; mean particle diameter: 0.3 μm; shell resin: polyacrylamide resin; manufactured by Mitsui Chemical), 2.5 parts of a 40% dispersion of zinc stearate with a mean particle size of 0.2 μm, 7.5 parts of a 40% dispersion of polyethylene wax (tradename: Nopcoat PEN-17, manufactured by SAN NOPCO LIMITED), 20 parts of polyamideamine-epichlorohydrin resin with a solids concentration of 25% (tradename: WS547, manufactured by JAPAN PMC CORPORATION) as crosslinking agent, and 56 parts of water were mixed and stirred, giving a protective layer aqueous coating composition.

Preparation of Heat-sensitive Recording Material

To one side of acid-free paper (support) weighing 64 g/m$^2$ was applied the undercoat layer coating composition in an amount of 9 g/m$^2$ on dry basis, followed by drying, to form an undercoat layer, and the heat-sensitive recording layer coating composition was applied to the resulting undercoat layer in an amount of 6 g/m$^2$ on dry basis, followed by drying, to form a heat-sensitive recording layer. Then, the interlayer coating composition was applied to the resulting heat-sensitive recording layer in an amount of 1 g/m$^2$ on dry basis, followed by drying, and the protective layer aqueous coating composition was applied to the resulting interlayer in an amount of 3 g/m$^2$ on dry basis, followed by drying, to form a protective layer, thus giving a heat-sensitive recording material. Each of the layers, when formed, was subjected to a smoothing treatment by a supercalender.

Example 2

A heat-sensitive recording material was obtained in the same manner as in Example 1 except that 3 parts of a 35% dispersion of zinc stearyl phosphate (tradename: Upole 1800, manufactured by Matsumoto Yushi) was used instead of the 2.5 parts of a 40% dispersion of zinc stearate in the preparation of the protective layer aqueous coating composition in Example 1.

Example 3

A heat-sensitive recording material was obtained in the same manner as in Example 1 except that 10 parts of a 40% dispersion of zinc stearate was used and the 40% dispersion of polyethylene wax was not used in the preparation of the protective layer aqueous coating composition in Example 1.

Example 4

A heat-sensitive recording material was obtained in the same manner as in Example 1 except that 460 parts of a latex with a core/shell structure having a solids concentration of 20% (tradename: Variaster B100; mean particle diameter: 0.6 μm; shell resin: polyacrylamide resin; manufactured by Mitsui Chemical) was used instead of 250 parts of the latex with a core/shell structure having a solids concentration of 37% (tradename: XFE3571; mean particle diameter: 0.3 μm; shell resin: polyacrylamide resin; manufactured by Mitsui Chemical) in the preparation of the protective layer aqueous coating composition in Example 1.

Example 5

A heat-sensitive recording material was obtained in the same manner as in Example 1 except that 20 parts of a 10% aqueous solution of acetoacetyl-modified polyvinyl alcohol (tradename: GOSEFIMER Z200, manufactured by The Nippon Synthetic Chemical Industry Co., Ltd.) was added to the protective layer aqueous coating composition in the preparation of the protective layer aqueous coating composition in Example 1.

Example 6

A heat-sensitive recording material was obtained in the same manner as in Example 1 except that 45 parts of a 10% aqueous solution of acetoacetyl-modified polyvinyl alcohol (tradename: GOSEFIMER Z200, manufactured by The Nippon Synthetic Chemical Industry Co., Ltd.) was added to the protective layer aqueous coating composition in the preparation of the protective layer aqueous coating composition in Example 1.

Example 7

A heat-sensitive recording material was obtained in the same manner as in Example 1 except that 5 parts of a 10% aqueous solution of acetoacetyl-modified polyvinyl alcohol (tradename: GOSEFIMER Z200, manufactured by The Nippon Synthetic Chemical Industry Co., Ltd.) was added to the protective layer aqueous coating composition in the preparation of the protective layer aqueous coating composition in Example 1.

Example 8

A heat-sensitive recording material was obtained in the same manner as in Example 1 except that 80 parts of 10% aqueous solution of acetoacetyl-modified polyvinyl alcohol (tradename: GOSEFIMER Z200, manufactured by The Nippon Synthetic Chemical Industry Co., Ltd.) was added to the protective layer aqueous coating composition in the preparation of the protective layer aqueous coating composition in Example 1.

Example 9

A heat-sensitive recording material was obtained in the same manner as in Example 1 except that 20 parts of a 10% aqueous solution of diacetone-modified polyvinyl alcohol (tradename: D-500, manufactured by Unitika Chemical) was added to the protective layer aqueous coating composition in the preparation of the protective layer aqueous coating composition in Example 1.

Example 10

A heat-sensitive recording material was obtained in the same manner as in Example 1 except that 20 parts of a 10% aqueous solution of fully saponified polyvinyl alcohol (tradename: PVA110, manufactured by Kuraray) was added to the protective layer aqueous coating composition in the preparation of the protective layer aqueous coating composition in Example 1.

Example 11

A heat-sensitive recording material was obtained in the same manner as in Example 1 except that 800 parts of a 10% aqueous solution of acetoacetyl-modified polyvinyl alcohol (tradename: GOSEFIMER Z200, manufactured by The Nippon Synthetic Chemical Industry Co.,Ltd.) was used instead of 800 parts of the 10% aqueous solution of diacetone-modified polyvinyl alcohol (tradename: D-500, manufactured by Unitika Chemical) in the preparation of the interlayer coating composition in Example 1.

Example 12

A heat-sensitive recording material was obtained in the same manner as in Example 1 except that 800 parts of a 10% aqueous solution of silicon-modified polyvinyl alcohol (tradename: R1130, manufactured by Kuraray) was used instead of 800 parts of the 10% aqueous solution of diacetone-modified polyvinyl alcohol (tradename: D-500, manufactured by Unitika Chemical) in the preparation of the interlayer coating composition in Example 1.

Example 13

A heat-sensitive recording material was obtained in the same manner as in Example 1 except that 800 parts of a 10% aqueous solution of carboxy-modified polyvinyl alcohol (tradename: KL-318, manufactured by Kuraray) was used instead of 800 parts of the 10% aqueous solution of diacetone-modified polyvinyl alcohol (tradename: D-500, manufactured by Unitika Chemical) in the preparation of the interlayer coating composition in Example 1.

Example 14

A heat-sensitive recording material was obtained in the same manner as in Example 1 except that 800 parts of 10% aqueous solution of partially saponified polyvinyl alcohol (tradename: PVA-210, manufactured by Kuraray) was used instead of 800 parts of the 10% aqueous solution of diacetone-modified polyvinyl alcohol (tradename: D-500, manufactured by Unitika Chemical) in the preparation of the interlayer coating composition in Example 1.

Example 15

A heat-sensitive recording material was obtained in the same manner as in Example 1 except that no interlayer was provided in the preparation of the heat-sensitive recording material in Example 1.

Example 16

A heat-sensitive recording material was obtained in the same manner as in Example 1 except that 2.5 parts of the 40% dispersion of zinc stearate with a mean particle diameter of 0.2 $\mu$m and 7.5 parts of the 40% dispersion of polyethylene wax (tradename: Nopcoat PEN-17, manufactured by SANNOPCO LIMITED) were not added in the preparation of the protective layer aqueous coating composition in Example 1.

Comparative Example 1

A heat-sensitive recording material was obtained in the same manner as in Example 1 except that 175 parts of an acrylic latex without a core/shell structure having a solids concentration of 53% (tradename: DICNAL RT25, manufactured by DAINIPPON INK AND CHEMICALS, INCORPORATED) was used instead of 250 parts of the latex of resin particles with a core/shell structure having a solids concentration of 37% (tradename: XFE3571; mean particle diameter: 0.3 $\mu$m; shell resin: polyacrylamide resin; manufactured by Mitsui Chemical) in the preparation of the protective layer aqueous coating composition in Example 1.

Comparative Example 2

A heat-sensitive recording material was obtained in the same manner as in Example 1 except that in place of 250 parts of the latex of resin particles with a core/shell structure having a solids concentration of 37% (tradename: XFE3571; mean particle diameter: 0.3 $\mu$m; shell resin: polyacrylamide resin; manufactured by Mitsui Chemical), 200 parts of said latex and 46 parts of a 40% aqueous dispersion of kaolin (tradename: UW-90; mean particle diameter: 0.8 $\mu$m; manufactured by Englehard) were used in the preparation of the protective layer aqueous coating composition in Example 1.

Comparative Example 3

A heat-sensitive recording material was obtained in the same manner as in Example 1 except that in place of 250 parts of the latex of resin particles with a core/shell structure having a solids concentration of 37% (tradename: XFE3571; mean particle diameter: 0.3 μm; shell resin: polyacrylamide resin; manufactured by Mitsui Chemical), 200 parts of said latex and 34 parts of 55% aqueous dispersion of precipitated calcium carbonate (tradename: Brilliant S-15; mean particle diameter: 0.15 μm; manufactured by SHIRAISHI CALCIUM) were used in the preparation of the protective layer aqueous coating composition in Example 1.

Comparative Example 4

A heat-sensitive recording material was obtained in the same manner as in Example 1 except that in place of 250 parts of the latex of resin particles with a core/shell structure having a solids concentration of 37% (tradename: XFE3571; mean particle diameter: 0.3 μm; shell resin: polyacrylamide resin; manufactured by Mitsui Chemical), 200 parts of said latex and 93 parts of colloidal silica with a solids concentration of 20% (tradename: Snowtex N; mean particle diameter: 0.02 μm; by NISSAN CHEMICAL INDUSTRIES, LTD.) were used in the preparation of the protective layer aqueous coating composition in Example 1.

The heat-sensitive recording materials obtained in the above examples and comparative examples were evaluated for the following physical properties. The results are shown in Table 1 below.

Gloss

The gloss A after the formation of the protective layer and the gloss B after supercalendering treatment were measured in accordance with the Testing method for 75 degree specular glossiness of paper according to JIS P-8142.

Color Formation and Sticking Resistance

A thermosensitive printing tester (trade name: TH-PMD, manufactured by OKURA DENKI) was used to form color on the heat-sensitive recording materials with 0.5 mJ/dot of applied energy, and the noise during running was observed. The density of the recorded portions was measured with a Macbeth densitometer (model RD-914, manufactured by Macbeth) in visual mode.

Abnormal recording resulting from sticking were visually assessed to evaluate the sticking resistance according to the following criteria.

◎: no abnormal recording as a result of sticking

○: a few abnormal recording as a result of sticking

X: many abnormal recording as a result of sticking

Water Resistance

A drop of distilled water (25° C.) was allowed to fall onto the protective layer, and the recorded portion was rubbed 20 times with the finger to assess coating film strength.

◎: no separation of heat-sensitive recording layer

○: slight separation of heat-sensitive recording layer

X: considerable separation of heat-sensitive recording layer

Haze Value of Protective Layer

In order to measure the haze value of the protective layer, the protective layer aqueous coating composition was applied to a transparent PET film (tradename: HMW100, manufactured by Teijin) in an amount of 3 g/m$^2$ on dry basis, and the coating was dried for 1 minute at 70° C. Haze value was measured using a haze meter (tradename: TC-H1V, by Tokyo Denshoku, based on JIS K 7105). Since the PET film itself had a haze value of 1, the haze value of the protective layer is obtained by reducing 1 (haze value of PET film) from the measured value.

TABLE 1

| | Color formation | Gloss A | Gloss B | Sticking resistance | Water resistance | Haze value |
|---|---|---|---|---|---|---|
| Example 1 | 1.35 | 88 | 92 | ◎ | ◎ | 5 |
| Example 2 | 1.35 | 88 | 91 | ◎ | ◎ | 5 |
| Example 3 | 1.33 | 86 | 88 | ○ | ◎ | 5 |
| Example 4 | 1.33 | 78 | 86 | ◎ | ◎ | 7 |
| Example 5 | 1.32 | 86 | 90 | ◎ | ◎ | 5 |
| Example 6 | 1.32 | 82 | 86 | ◎ | ◎ | 5 |
| Example 7 | 1.33 | 86 | 91 | ◎ | ◎ | 5 |
| Example 8 | 1.34 | 81 | 83 | ◎ | ◎ | 5 |
| Example 9 | 1.35 | 87 | 91 | ◎ | ○ | 5 |
| Example 10 | 1.34 | 87 | 90 | ◎ | ◎ | 5 |
| Example 11 | 1.35 | 88 | 92 | ◎ | ◎ | 5 |
| Example 12 | 1.35 | 89 | 94 | ◎ | ◎ | 5 |
| Example 13 | 1.35 | 88 | 91 | ◎ | ◎ | 5 |
| Example 14 | 1.31 | 85 | 87 | ◎ | ◎ | 5 |
| Example 15 | 1.32 | 81 | 83 | ◎ | ◎ | 5 |
| Example 16 | 1.35 | 89 | 94 | ○ | ◎ | 3 |
| Comparative Example 1 | 1.31 | 43 | 51 | X | ◎ | 6 |
| Comparative Example 2 | 1.32 | 68 | 71 | ◎ | ◎ | 18 |
| Comparative Example 3 | 1.29 | 52 | 55 | ◎ | ◎ | 42 |
| Comparative Example 4 | 1.34 | 72 | 75 | ◎ | ◎ | 12 |

Table 1 shows that the heat-sensitive recording materials of the present invention have excellent gloss, and are excellent in sticking resistance and water resistance.

What is claimed is:

1. A process for producing a heat-sensitive recording material comprising (a) a support, (b) a heat-sensitive recording layer containing a leuco dye and a developer, and (c) a protective layer comprising a resin in the form of a film and formed on the heat-sensitive recording layer, the protective layer having a gloss (based on JIS P 8142) of not less than 80%, the process comprising the steps of coating the heat-sensitive recording layer with a protective layer aqueous coating composition containing resin particles with a core/shell structure in an amount of not less than 80 mass % of the total solids of the protective layer aqueous coating composition, and then drying the coating, the resin particles with a core/shell structure having a mean particle diameter of between 0.05 and 0.5 μm.

2. The process according to claim 1, wherein the resin particles with a core/shell structure have a mean particle diameter of about 0.01 to 0.4 μm.

3. The process according to claim 1, wherein the resin of the shell has a glass transition temperature (Tg) of not less than 200° C.

4. The process according to claim 1, wherein the resin of the shell of the resin particles having a core/shell structure is a (meth)acrylamide polymer or a copolymer obtained by the copolymerization of (meth)acrylamide and an unsaturated monomer which is copolymerizable with (meth) acrylamide.

5. The process according to claim 1, wherein the protective layer aqueous coating composition further contains a lubricant in an amount of 1 to 10 mass % relative to the total solids.

6. The process according to claim 1, wherein the protective layer aqueous coating composition further contains a crosslinking agent.

7. The process according to claim 6, wherein the crosslinking agent is a polyamideamine-epichlorohydrin resin.

8. The process according to claim 1, wherein the protective layer aqueous coating composition contains at least one member selected from the group consisting of fully or partially saponified polyvinyl alcohols and modified polyvinyl alcohols, in an amount of between 0.5 and 10 mass parts per 100 mass parts of resin particles having a core/shell structure.

9. The process according to claim 1, wherein the protective layer aqueous coating composition contains at least one member selected from the group consisting of acetoacetyl-modified polyvinyl alcohols and diacetone-modified polyvinyl alcohols.

10. The process according to claim 1, which further comprises the step of forming an undercoat layer by coating the support with an undercoat layer coating composition containing a binder and at least one member selected from the group consisting of oil-absorbing pigments and organic hollow particles, and then drying the coating.

11. A process for producing a heat-sensitive recording material comprising (i) a support, (ii) a heat-sensitive recording layer containing a leuco dye and a developer, (iii) an interlayer comprising a film-forming resin and formed on the heat-sensitive recording layer, and (iv) a protective layer comprising a resin in the form of a film and formed on the interlayer, the protective layer having a gloss (based on JIS P 8142) of not less than 80%, said process comprising the steps of:

forming a heat-sensitive recording material comprising a support and heat-sensitive recording layer;

coating the heat-sensitive recording layer with an interlayer coating composition containing a film-forming resin, and then drying the coating to form an interlayer; and coating the interlayer with a protective layer aqueous coating composition containing at least resin particles with a core/shell structure, the resin particles with a core/shell structure having a mean particle diameter of between 0.05 to 0.5 $\mu$m, said protective layer aqueous coating composition comprising said resin particles with a core/shell structure in an amount of not less than 80 mass % of the total solids of the protective layer aqueous coating composition, and then drying the coating.

12. The process according to claim 11, wherein the film-forming resin in the interlayer is a modified polyvinyl alcohol.

13. The process according to claim 11, wherein the film-forming resin of the interlayer is at least one member selected from the group consisting of carboxy-modified polyvinyl alcohols, acetoacetyl-modified polyvinyl alcohols, diacetone-modified polyvinyl alcohols and silicon-modified polyvinyl alcohols.

14. The process according to claim 11, which further comprises the step of forming an undercoat layer by coating the support with an undercoat layer coating composition containing a binder and at least one member selected from the group consisting of oil-absorbing pigments and organic hollow particles, and then drying the coating.

15. The process according to claim 1, which further comprises a supercalendering step after the layers have been formed.

16. A process for producing a heat-sensitive recording material comprising (a) a support, (b) a heat-sensitive recording layer containing a leuco dye and a developer, and (c) a protective layer comprising a resin in the form of a film and formed on the heat-sensitive recording layer, the protective layer having a gloss (based on JIS P 8142) of not less than 80%, the process comprising the steps of coating the heat-sensitive recording layer with a protective layer aqueous coating composition containing resin particles with a core/shell structure in an amount of not less than 80 mass % of the total solids of the protective layer aqueous coating composition, drying the coating and then supercalendering the layers formed, the resin particles with a core/shell structure having a mean particle diameter of between 0.05 and 0.5 $\mu$m, the resin of the shell of the resin particles having a core/shell structure being a (meth)acrylamide polymer or a copolymer obtained by the copolymerization of (meth)acrylamide and an unsaturated monomer which is copolymerizable with (meth)acrylamide.

17. The process according to claim 11, which further comprises a supercalendering step after the layers have been formed.

18. A process for producing a heat-sensitive recording material comprising (i) a support, (ii) a heat-sensitive recording layer containing a leuco dye and a developer, (iii) an interlayer comprising a film-forming resin and formed on the heat-sensitive recording layer, and (iv) a protective layer comprising a resin in the form of a film and formed on the interlayer, the protective layer having a gloss (based on JIS P 8142) of not less than 80%, said process comprising the steps of:

forming a heat-sensitive recording material comprising a support and heat-sensitive recording layer;

coating the heat-sensitive recording layer with an interlayer coating composition containing a film-forming resin, and then drying the coating to form an interlayer;

coating the interlayer with a protective layer aqueous coating composition containing at least resin particles with a core/shell structure, the resin particles with a core/shell structure having a mean particle diameter of between 0.05 to 0.5 $\mu$m, the resin of the shell of the resin particles having a core/shell structure being a (meth)acrylamide polymer or a copolymer obtained by the copolymerization of (meth)acrylamide and an unsaturated monomer which is copolymerizable with (meth)acrylamide, said protective layer aqueous coating composition comprising said resin particles with a core/shell structure in an amount of not less than 80 mass % of the total solids of the protective layer aqueous coating composition, and then drying the coating; and supercalendering after the layers have been formed.

* * * * *